US011501605B1

(12) United States Patent
Guo et al.

(10) Patent No.: US 11,501,605 B1
(45) Date of Patent: Nov. 15, 2022

(54) METHOD AND APPARATUS FOR DATA PROCESSING, ELECTRONIC DEVICE, AND STORAGE MEDIUM

(71) Applicant: SENSETiME INTERNATIONAL PTE. LTD., Singapore (SG)

(72) Inventors: Zhiyang Guo, Singapore (SG); Xinxin Wang, Singapore (SG)

(73) Assignee: SENSETIME INTERNATIONAL PTE. LTD., Singapore (SG)

( * ) Notice: Subject to any disclaimer, the term of this patent is extended or adjusted under 35 U.S.C. 154(b) by 0 days.

(21) Appl. No.: 17/363,383

(22) Filed: Jun. 30, 2021

Related U.S. Application Data

(63) Continuation of application No. PCT/IB2021/055660, filed on Jun. 25, 2021.

(30) Foreign Application Priority Data

Jun. 23, 2021 (SG) ..... 10202106869P

(51) Int. Cl.
*G07F 17/32* (2006.01)

(52) U.S. Cl.
CPC ..... *G07F 17/322* (2013.01); *G07F 17/3225* (2013.01); *G07F 17/3293* (2013.01)

(58) Field of Classification Search
USPC ..... 463/31
See application file for complete search history.

(56) References Cited

U.S. PATENT DOCUMENTS

| | | | | |
|---|---|---|---|---|
| 10,748,376 | B2 * | 8/2020 | Zhang | G06N 20/20 |
| 2017/0161987 | A1 * | 6/2017 | Bulzacki | G06V 10/50 |
| 2018/0247134 | A1 * | 8/2018 | Bulzacki | G06V 10/22 |
| 2019/0108710 | A1 * | 4/2019 | French | G07F 17/3267 |
| 2019/0236891 | A1 | 8/2019 | Shigeta | |
| 2019/0392273 | A1 | 12/2019 | Shigeta | |
| 2020/0273287 | A1 * | 8/2020 | Shigeta | G07F 17/3234 |
| 2020/0302168 | A1 | 9/2020 | Shigeta | |
| 2020/0394480 | A1 * | 12/2020 | Shigeta | A63F 13/80 |
| 2021/0110225 | A1 | 4/2021 | Shigeta | |
| 2021/0118258 | A1 * | 4/2021 | Shigeta | G07F 17/322 |

OTHER PUBLICATIONS

Written Opinion of the Singaporean application No. 10202106869P, dated Sep. 27, 2021, 8 pgs.

(Continued)

*Primary Examiner* — Pierre E Elisca
(74) *Attorney, Agent, or Firm* — Cooper Legal Group, LLC

(57) ABSTRACT

Provided is a method for data processing. The method includes the following actions. Recognition data obtained by performing game object recognition on each frame of game image in a game image frame sequence is acquired. The recognition data includes type data of a game object and position data of the game object on a game table. At least one heat zone map corresponding to a surface of the game table is acquired. Each heat zone map represents a game region on the surface of the game table corresponding to each of respective at least one type of game object. Based on the type data, the position data, and the at least one heat zone map, recognition data of a game object that is located in a corresponding game region in each frame of game image in the game image frame sequence is filtered out.

18 Claims, 13 Drawing Sheets

(56) References Cited

OTHER PUBLICATIONS

International Search Report in the international application No. PCT/IB2021/055660, dated Oct. 11, 2021, 4 pgs.
Written Opinion of the International Search Authority in the international application No. PCT/IB2021/055660, dated Oct. 11, 2021, 5 pgs.
First Office Action of the Australian application No. 2021204621, dated Jun. 29, 2022, 5 pgs.

* cited by examiner

METHOD AND APPARATUS FOR DATA PROCESSING, ELECTRONIC DEVICE, AND STORAGE MEDIUM

CROSS-REFERENCE TO RELATED APPLICATION

The present application is a continuation of International Application No. PCT/IB2021/055660, filed on Jun. 25, 2021, which claims priority to Singapore Patent Application No. 10202106869P, filed to the Singapore Patent Office on 23 Jun. 2021 and entitled "METHOD AND APPARATUS FOR DATA PROCESSING, ELECTRONIC DEVICE, AND STORAGE MEDIUM". The contents of International Application No. PCT/IB2021/055660 and Singapore Patent Application No. 10202106869P are incorporated herein by reference in their entireties.

BACKGROUND

In an entertainment place, multiple cameras are provided to detect and recognize an object on a surface of the game table and related behaviors, and convert same into a computer language so as to send to a game state detection module for further logic processing. Data detected and recognized on the surface of the game table includes data of pokers, makers, cash, game currency, hands, faces, and objects of other types. However, during processing of different game state detection modules, the data of only one or more types of object is required, the data of the other types is useless and interferes service logic processing.

SUMMARY

The disclosure relates to the field of computer vision, and relates, but not limited, to a method and apparatus for data processing, an electronic device, and a storage medium.

The technical solutions of the embodiments of the disclosure are implemented as follows.

According to a first aspect, the embodiments of the disclosure provide a method for data processing, including: acquiring recognition data obtained by performing game object recognition on each frame of game image in a game image frame sequence, wherein the recognition data comprises type data of a game object and position data of the game object on a game table; acquiring at least one heat zone map corresponding to a surface of the game table, wherein each heat zone map represents a game region on the surface of the game table corresponding to each of respective at least one game object type; and filtering out, based on the type data, the position data, and the at least one heat zone map, recognition data of a game object that is located in a corresponding game region in each frame of game image in the game image frame sequence.

According to a second aspect, the embodiments of the disclosure provide a game table based apparatus for data processing, including a first acquisition module, a second acquisition module, and a filtering module.

The first acquisition module is configured to acquire recognition data obtained by performing game object recognition on each frame of game image in a game image frame sequence, wherein the recognition data comprises type data of a game object and position data of the game object on a game table. The second acquisition module is configured to acquire at least one heat zone map corresponding to a surface of the game table, wherein each heat zone map represents a game region on the surface of the game table corresponding to each of respective at least one game object type. The filtering module is configured to filter out, based on the type data, the position data, and the at least one heat zone map, recognition data of a game object that is located in a corresponding game region in each frame of game image in the game image frame sequence.

According to a third aspect, the embodiments of the disclosure provide an electronic device, which includes a memory and a processor, wherein the memory stores a computer program capable of running in the processor, and the processor executes the program to implement the steps in the method for data processing.

According to a fourth aspect, the embodiments of the disclosure provide a non-transitory computer-readable storage medium having stored thereon a computer program that, when being executed by a processor, implements the steps in a method for data processing, the method including: acquiring recognition data obtained by performing game object recognition on each frame of game image in a game image frame sequence, wherein the recognition data comprises type data of a game object and position data of the game object on a game table; acquiring at least one heat zone map corresponding to a surface of the game table, wherein each heat zone map represents a game region on the surface of the game table corresponding to each of respective at least one game object type; and filtering out, based on the type data, the position data, and the at least one heat zone map, recognition data of a game object that is located in a corresponding game region in each frame of game image in the game image frame sequence.

According to a fifth aspect, the embodiments of the disclosure provide a game table based apparatus for data processing, including: a processor; and a memory configured to store instructions which, when being executed by the processor, cause the processor to carry out the following: acquiring recognition data obtained by performing game object recognition on each frame of game image in a game image frame sequence, wherein the recognition data comprises type data of a game object and position data of the game object on a game table; acquiring at least one heat zone map corresponding to a surface of the game table, wherein each heat zone map represents a game region on the surface of the game table corresponding to each of respective at least one game object type; and filtering out, based on the type data, the position data, and the at least one heat zone map, recognition data of a game object that is located in a corresponding game region in each frame of game image in the game image frame sequence.

BRIEF DESCRIPTION OF THE DRAWINGS

In order to describe the technical solutions of the embodiments of the disclosure more clearly, the drawings required to be used in the descriptions about the embodiments will be simply introduced below. It is apparent that the drawings described below are merely some embodiments of the disclosure. Other drawings may further be obtained by those of ordinary skill in the art according to these drawings without creative work.

DETAILED DESCRIPTION

In order to make the purpose, technical solutions, and advantages of the embodiments of the disclosure clearer, the technical solutions in the embodiments of the disclosure will be clearly and completely described below in combination with the drawings in the embodiments of the disclosure. It is apparent that the described embodiments are not all embodiments but part of embodiments of the disclosure. The following embodiments are adopted to describe the application rather than limit the scope of the application. All other embodiments obtained by those of ordinary skill in the art on the basis of the embodiments in the application without creative work shall fall within the scope of protection of the application.

"Some embodiments" involved in the following descriptions describes a subset of all possible embodiments. However, it can be understood that "some embodiments" may be the same subset or different subsets of all the possible embodiments, and may be combined without conflicts.

It is to be pointed out that term "first/second/third" involved in the embodiments of the disclosure is only for distinguishing similar objects and does not represent a specific sequence of the objects. It can be understood that "first/second/third" may be interchanged to specific sequences or orders if allowed to implement the embodiments of the disclosure described herein in sequences except the illustrated or described ones.

Those skilled in the art can understand that, unless otherwise defined, all the terms (including technical terms and scientific terms) used herein have the same meanings usually understood by those of ordinary skill in the art of the embodiments of the disclosure. It should also be understood that terms defined in, for example, a general dictionary, should be understood to have the same meanings as those in the context of the conventional art, and may not be explained as idealized or too formal meanings, unless otherwise specifically defined like those here.

Computer vision, as a science studying how to make machines "see", refers to recognition, tracking and measurement of targets using video cameras and computers instead of human eyes, and performing further image processing.

Figure 1:
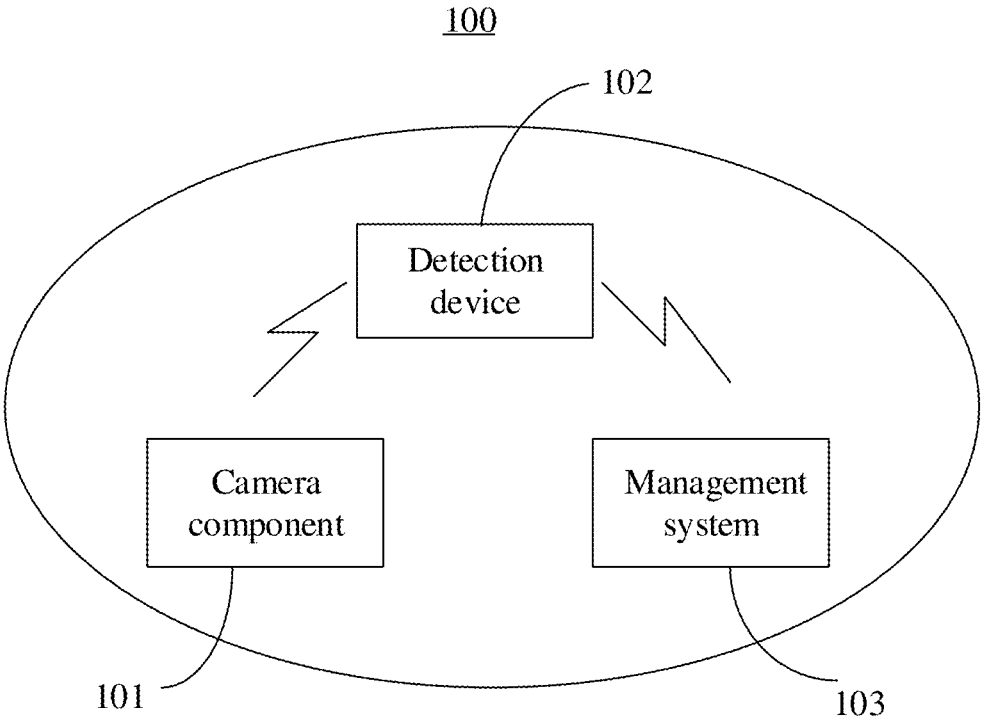
FIG. 1 illustrates a structural diagram of a data processing system according to an embodiment of the disclosure.

FIG. 1 illustrates a structural diagram of a data processing system according to an embodiment of the disclosure. As illustrates in FIG. 1, the system 100 may include a camera component 101, a detection device 102, and a management system 103.

In some implementations, the detection device 102 may correspond to only one camera component 101. In some other implementations, the detection device 102 may correspond to multiple camera components 101. For example, the multiple camera components 101 corresponding to the detection device 102 may be camera components 101 configured to photograph game tables in one or more entertainment places. Alternatively, the multiple camera components 101 corresponding to the detection device 102 may be camera components 101 configured to photograph game tables in a partial region in an entertainment place. The partial region may be an ordinary region, or may be a Very Important Person (VIP) region, etc.

In some implementations, the detection device 102 may be provided in the entertainment place. In some other implementations, the detection device 102 may be provided at a cloud end. The detection device 102 may be connected with a server in the entertainment place.

The camera component 101 may be in communication connection with the detection device 102. In some implementations, the camera component 101 may shoot real-time images periodically or aperiodically, and send the shot real-time images to the detection device 102. For example, under the condition that the camera component 101 includes multiple cameras, the multiple cameras may shoot real-time images at an interval of a target duration, and send the shot real-time images to the detection device 102. The multiple cameras may shoot real-time images in a simultaneous manner or not. In some other implementations, the camera component 101 may shoot real-time videos, and send the real-time videos to the detection device 102. For example, under the condition that the camera component 101 includes multiple cameras, the multiple cameras may send shot real-time videos to the detection device 102 respectively such that the detection 102 extracts real-time images from the real-time videos. The real-time image in the embodiments of the disclosure may be any game image described below.

In some implementations, the camera component may keep shooting images, thereby keeping sending the shot images to the detection device 102. In some other implementations, the camera component may be triggered by a target to shoot an image. For example, the camera component may start shooting an image responsive to an instruction that a game result comes out or placement of game currency is completed.

The detection device 102 may analyze the game table and a game controller and player at the game table in the entertainment place based on the real-time images to determine whether actions of the game controller and/or the player conform to rules or are proper.

The detection device 102 may be in communication connection with the management system 103. Under the condition that the detection device 102 determines that the actions of the game controller or the player are improper, in order to avoid the loss of a casino or players, the detection device 102 may send target alert information to the management system 103 on the game table corresponding to the game controller or player whose actions are improper, such that the management system 103 may give an alert corresponding to the target alert information to alert the game controller or the player through the game table. Thus, the situation that the improper actions of the game controller or the player cause loss to the entertainment place or the players is avoided.

In some embodiments, the detection device 102 may include an edge device, or an end device. The detection device 102 may be connected with the server, so that the server may correspondingly control the detection device, and/or, the detection device may use service provided by the server.

In some implementations, the management system 103 may include a display device. The display device is configured to display an identifier of at least one region, information of at least one player, an alert reason, etc. In some other implementations, the management system 103 may include a sub-apparatus corresponding to each region on the game table. Each sub-apparatus may include at least one of a display apparatus, a sound production apparatus, a light emitting apparatus, or a vibration apparatus.

The embodiments of the disclosure are not limited thereto. In the embodiment corresponding to FIG. 1, the camera component 101, detection device 102 and management system 103 are illustrated to be independent from each other. However, in other embodiments, the camera component 101 and the detection device 102 may integrated together, or, the detection device 102 and the management system 103 may be integrated together.

A conventional entertainment place is relatively low in intelligence. A game process and payout are much controlled by a game controller, and it is hard to track and judge irregular actions. The embodiments of the disclosure propose a scenario of deploying an intelligent entertainment place based on a computer vision technology, and a cloud device and multiple extensible edge Artificial Intelligence (AI) nodes are provided. Each end device includes an edge AI node, which runs a set of intelligent entertainment place service to control the overall progress of a game on a game table, and implement effective tracking and alert on irregular actions of a game controller or players to reduce the human cost on one hand, and on the other hand, to automatically count the overall game conditions (income and the number of tables in use) of the entertainment place to assist the manager in making decisions.

A game table based method for data processing provided in the embodiments of the disclosure will be described below. According to the method, data recognized by a parsing layer may be cleaned to filter away useless tabletop information, and cleaned data is transmitted to each game state detection module of a service layer. Therefore, each game state detection module may directly acquire the corresponding recognition data for further analysis processing, and there is no need for different game state detection modules to perform data cleaning and conversion operations again.

The technical solutions provided in the embodiments of the disclosure at least have the following beneficial effects.

In the embodiments of the disclosure, the recognition data obtained by performing game object recognition on each frame of game image in the game image frame sequence is acquired, the recognition data including the type data of a game object and the position data of the game object on the game table. At least one heat zone map corresponding to the surface of the game table is acquired, each of the at least one heat zone map representing a game region on the surface of the game table corresponding to each of respective at least one game object type. Recognition data of a game object that is located in a corresponding game region in each frame of game image is filtered out based on the type data, the position data, and the at least one heat zone map. As such, a heat zone map is divided for each game state detection module based on game regions on the game tables, and based on each heat zone map, required recognition data is screened out for the corresponding game state detection module, and useless tabletop information that is recognized is filtered away. Therefore, different game state detection modules may process data in corresponding hot zones according to their own service detection functions, and the flexibility of the service logic may be improved.

Figure 2:
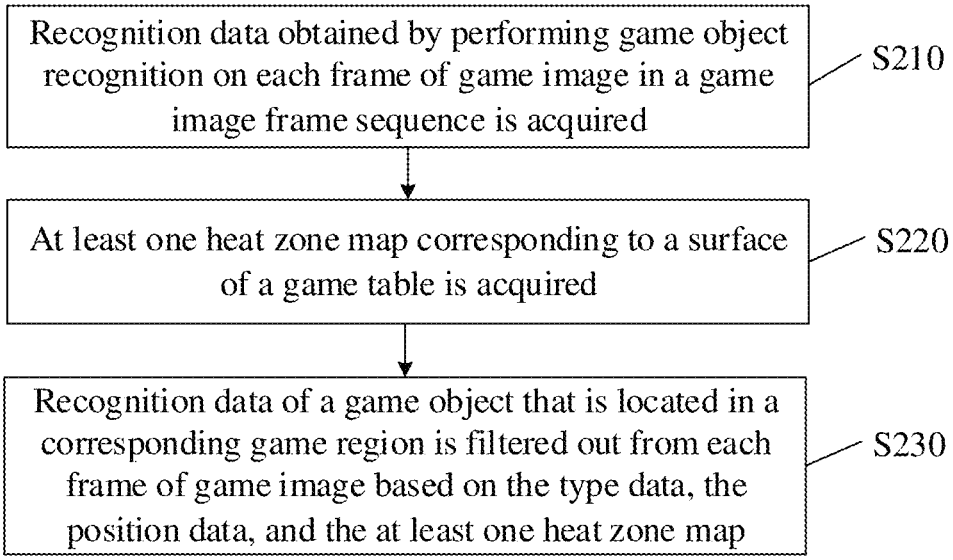
FIG. 2 illustrates a flowchart of a method for data processing according to an embodiment of the disclosure.

FIG. 2 illustrates a flowchart of a method for data processing according to an embodiment of the disclosure. As illustrated in FIG. 2, the method is applied to an edge AI node (arranged in the abovementioned detection device 102). The method at least includes the following operations.

In S210, recognition data obtained by performing game object recognition on each frame of game image in a game image frame sequence is acquired.

Here, each frame of game image is obtained by shooting a game table in a round of game. The recognition data includes type data of a game object and position data of the game object on the game table. The game object includes pokers, game currency, cash, hands, a markers, etc.

In the embodiments of the disclosure, the game on the game table may be Baccarat, or may be Golden Flower, Fishing Joy, Texas Poker, one-arm bandit, Five Card Stud, Pai Gow, Landlords, etc. The game on the game table may be a card game or a non-card game. In the following embodiments, descriptions will be made with the card game as an example. A round of game is divided into five stages according to a game process, i.e., an idle stage, a betting stage, a gaming stage, a payout stage, and a halt stage.

In the embodiments of the disclosure, real-time video shooting is performed on the game table using a camera component provided above the game table, and a shot video is sent to the edge AI node. Therefore, the edge AI node may extract the received video, and perform sampling based on an extracted video sequence of the game to obtain an image frame sequence.

Under the condition that the camera component includes one camera, a video shot by the camera may directly be taken as the image frame sequence, or, images are truncated from the video shot by the camera are taken as the image frame sequence. Under the condition that the camera component includes multiple cameras, the multiple cameras may shoot multiple frames of sub-images respectively, and a server may synthesize the multiple frames of sub-images to obtain the image frame sequence. In some implementations, compositing the multiple frames of sub-images may include stitching the multiple frames of sub-images. For example, if a left-top region in a sub-image in the multiple frames of sub-images is occluded, and a right-bottom region in another sub-image is occluded, the multiple frames of sub-images may be synthesized to obtain a final clear and available image frame sequence.

In the embodiments of the disclosure, the recognition data is obtained by performing recognition on each frame of game image in the image frame sequence through a trained target detection module and behavior identification model in a parsing layer of the edge AI node. In a round of game, the parsing layer performs recognition on each frame of game image in an image frame sequence that is acquired in real time, and inputs recognition data of each frame of game image to a message queue as a message body. A service layer acquires the recognition data of each frame of game image from the message queue, and performs data preprocessing.

Finally, each game state detection module performs logic analysis on processed recognition data.

It is to be noted that the parsing layer and the service layer are provided in the edge AI node. The parsing layer includes multiple algorithm models, such as an object detection algorithm, a recognition algorithm, and an association algorithm, and is configured to perform target detection and recognition on the video sequence acquired by the camera component, to obtain the recognition data of each frame of game image. Each game state detection module of the service layer acquires the recognition data of the parsing layer respectively for corresponding service logic processing, and interacts with a Casino Management System (CMS). A game state detection module is a software module that runs a corresponding detection logic to implement game state detection, including at least one of: detection of a present game progress, detection of a game prop state, detection of a game prop operating state of a game player/controller, detection of a game result, etc.

In some possible implementations, the service layer acquires, through the message queue, the recognition data obtained by performing recognition on each frame of game image in the image frame sequence. The recognition data of each frame of game image is obtained by the parsing layer through detection and recognition of each frame of game image, and is input to the message queue. As such, the service layer can perform real-time analysis and processing based on the recognition data of each frame of game image, to supervise in real time in the game process whether a person participating in the game breaks a game rule in each game stage, or to determine the game result and calculate incomes, etc.

In S220, at least one heat zone map corresponding to a surface of the game table is acquired.

Here, each of the at least one heat zone map represents a game region on the surface of the game table corresponding to each of respective at least one game object type. The game region on the tabletop includes a region for placing chips, a region for placing pokers, a region for placing makers, a region for exchanging game currency with cash, etc.

In some implementations, a corresponding heat zone map may be acquired for each of at least one game state detection module.

In some implementations, the region for placing game currency may include a player region, a banker region, a p-pair region, a b-pair region, and other regions. In some other implementations, the region for placing game currency further includes a region in front of each player for storing game currency.

In some implementations, the region for placing pokers may include a card dealing region and a card pulling region. The dealing region may further include a player card region and a banker card region. In some other implementations, the region for placing pokers may further include a region for useless cards, a region where a card case is located, and a region for used cards.

In the embodiments of the disclosure, the management system may issue a table type of the present game table through a configuration file. Each table type corresponds to respective different heat zone maps. For example, Tiger Fighter and Baccarat correspond to different table types. At the start of a round of game, all heat zone maps corresponding to the game table need to be loaded according to a configuration.

It is to be noted that the heat zone maps divided according to the table type of the game table are not fixed, but are divided according to a detection function of the game state detection module. For example, both game state detection module A and game state detection module B need to detect game currency, but focus on different regions respectively. As an example, module A focuses on a game currency device area for storing the game currency, and module B focuses on the area in which players place game currency. In such case, the two game state detection modules correspond to different heat zone maps.

In the embodiments of the disclosure, the edge AI node may divide the game into different game stages. A game state detection module is set for each of the different game stages to realize corresponding service function detection.

In S230, recognition data of a game object that is located in a corresponding game region in each frame of game image in the game image frame sequence is filtered out based on the type data, the position data, and the at least one heat zone map.

Here, for each game state detection module, recognition data that may be mapped to the heat zone map corresponding to the game state detection module is screened out from the recognition data of each frame of game image, such that the game state detection module needs to process only the recognition data in the corresponding heat zone map. Thus useless information is filtered away. As such, for different game state detection modules, the recognition data related to detection functions of the corresponding game state detection modules is screened out, and the flexibility of a service logic can be improved.

In the embodiments of the disclosure, the recognition data obtained by performing game object recognition on each frame of game image in the game image frame sequence is acquired, the recognition data including the type data of a game object and the position data of the game object on the game table. At least one heat zone map corresponding to the surface of the game table is acquired, each of the at least one heat zone map representing a game region on the surface of the game table corresponding to each of respective at least one game object type. Recognition data of a game object that is located in a corresponding game region in each frame of game image is filtered out based on the type data, the position data, and the at least one heat zone map. As such, based on the heat zone map divided for each game state detection module, required recognition data is screened out for the corresponding game state detection module, and useless tabletop information that is recognized is filtered away. Therefore, different game state detection modules may process data in corresponding hot zones according to their own service detection functions, and the flexibility of the service logic may be improved.

Figure 3:
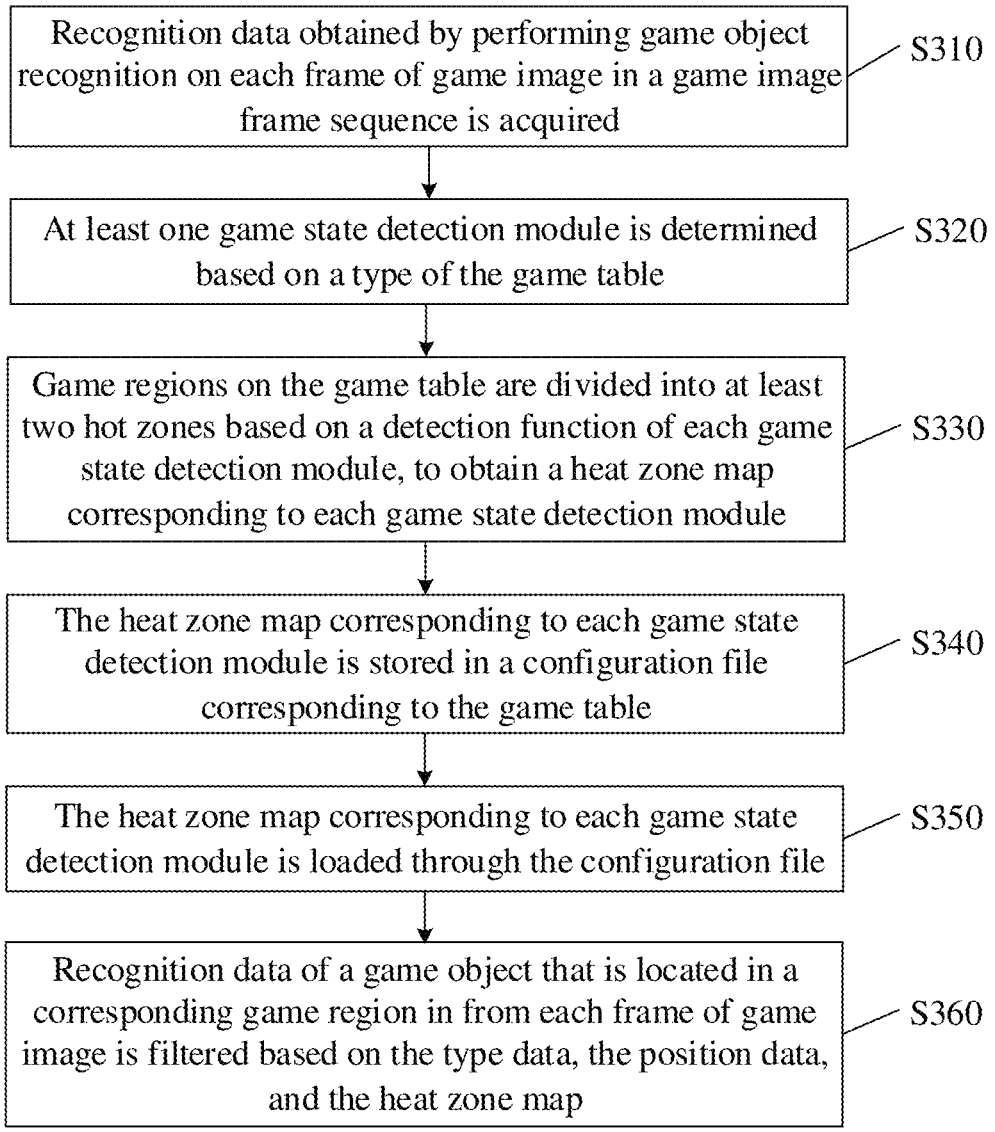
FIG. 3 illustrates a flowchart of a method for data processing according to an embodiment of the disclosure.

FIG. 3 illustrates a flowchart of a method for data processing according to an embodiment of the disclosure. As illustrated in FIG. 3, the method at least includes the following operations.

In S310, recognition data obtained by performing game object recognition on each frame of game image in a game image frame sequence is acquired.

Here, each frame of game image is obtained by shooting a game table in a round of game.

In some implementations, the recognition data obtained by performing recognition on each frame of game image in the image frame sequence may be acquired through a message queue. The recognition data of each frame of game image is obtained by a parsing layer performing detection and recognition on each frame of game image, and is input to the message queue. In some other implementations, the recognition data obtained by performing recognition on each frame of game image in the image frame sequence may also be acquired in another communication manner such as a socket. During practical implementation, the embodiments of the disclosure are not limited to any particular acquisition manner.

In S320, at least one game state detection module is determined based on a type of the game table.

Here, different types of the game table correspond to different table types of game tables. For example, a game table for Baccarat usually includes a player region and a banker region, and a game table for Tiger Fighter includes a region where a tiger is located and a region where a hero is located.

For each different game table type, respective different game state detection modules need to be provided to perform service logic detection on game regions on the tabletop. In some implementations, game currency change information in a betting region on the game table is detected in a dealing stage using a game currency detection module (no more bet) to determine whether new game currency is placed to or game currency is removed from the betting region. In some other implementations, suits, nominal values, etc., of pokers in a dealing region are detected in a payout stage using a dealing sequence check module, to further determine a game result. Therefore, real-time supervision of a game process and calculation of incomes are realized by providing the various game state detection modules.

In S330, game regions on the game table are divided into at least two hot zones based on a detection function of each game state detection module, to obtain a heat zone map corresponding to each game state detection module.

Here, the detection function of each game state detection module refers to that the game state detection module detects an object attribute in some regions on the game table and/or a behavior of an operating object, and further output a detection result by logic judgment. The heat zone map represents a game region detected by a game state detection module on a tabletop of the game table.

It is to be noted that different game state detection modules have respective different detection functions. Each game state detection module may need to detect at least one type of target object. For example, the game currency detection module needs to detect game currency and a hand that operates the game currency, while the dealing sequence check module only needs to detect pokers. Different game state detection modules detect different target objects and detection regions. Each game state detection module corresponds to a heat zone map.

Exemplarily, the dealing sequence check module needs to use poker information recognized by the parsing layer, and thus positions (including the dealing region, a pulling region, and a region of useless cards) where the pokers need to be placed from the start to end of the game are used as a heat zone map corresponding to the module. The game currency detection module needs to use game currency change information recognized by the parsing layer, and thus placement positions, namely betting regions (including a banker region and a player region), where all players place game currency for the game are used as a heat zone map corresponding to the module.

In S340, the heat zone map corresponding to each game state detection module is stored in a configuration file corresponding to the game table.

In S350, the heat zone map corresponding to each game state detection module is loaded through the configuration file.

Here, the configuration file includes resource and configuration information set corresponding to different service requirements. By modifying some values or files of the configuration file, an application may run different service logics, so that a single application version may simultaneously meet different scene requirements.

It is to be noted that an application service running on the game table usually needs to use different configuration files for adaptation to different game rules and hardware. The configuration file mainly includes a game table configuration of an entertainment place, and configuration information of region types, game currency types, etc., on game tables. Application software includes all latest configuration files in a new-version package. If an edge AI node installs a latest version, resource files of all scenes have been included, and corresponding resource files may be used to achieve purposes in different scenes.

During implementation, the type of the present game table is detected in real time to update the configuration file in real time, and the heat zone map corresponding to each game state detection module is loaded, to ensure efficient realization of the detection function of each game state detection module.

In S360, recognition data of a game object that is located in a corresponding game region in from each frame of game image is filtered based on the type data, the position data, and the heat zone map.

In some implementations, first, at least one type of detected by each game state detection module is determined. Recognition data of the at least one type of in the recognition data of each frame of game image is determined as a candidate information set. Then, whether a practical position of each target object in the candidate information set may be mapped to the heat zone map corresponding to the game state detection module is judged. As such, only the recognition data of the target object in the heat zone map is filtered out.

In some implementations, a coordinate point of each target object may be compared with a coordinate set of the heat zone map corresponding to the game state detection module to determine whether the practical position of the target object in the candidate information set may be mapped to the heat zone map corresponding to the game state detection module. In some other implementations, a color attribute of game region to which each target object is mapped may be compared with a color attribute of each hot zone in the heat zone map corresponding to the game state detection module to determine whether the practical position of the target object in the candidate information set may be mapped to the heat zone map corresponding to the game state detection module.

Exemplarily, recognition data of all pokers is obtained by classification from the recognition data of each frame of game image, and then each poker is compared, in a traversing manner, with the heat zone map corresponding to the game state detection module that processes poker information, to filter away other interference data and leave only the recognition data of a poker in the corresponding heat zone map.

In the embodiments of the disclosure, multiple game state detection modules are provided based on service provided in the edge AI node to provide different detection functions respectively, and meanwhile, a heat zone map is divided for each game state detection module based on the game regions on the game table. Before the game starts, the heat zone map corresponding to each game state detection module is loaded through the configuration file issued by the management system. Based on each heat zone map, required recognition data is screened out for the corresponding game state detection module, and useless tabletop information that is recognized is filtered away. Therefore, different game state detection modules may process data in corresponding hot zones according to their own service detection functions, and the flexibility of the service logic can be improved.

Figure 4:
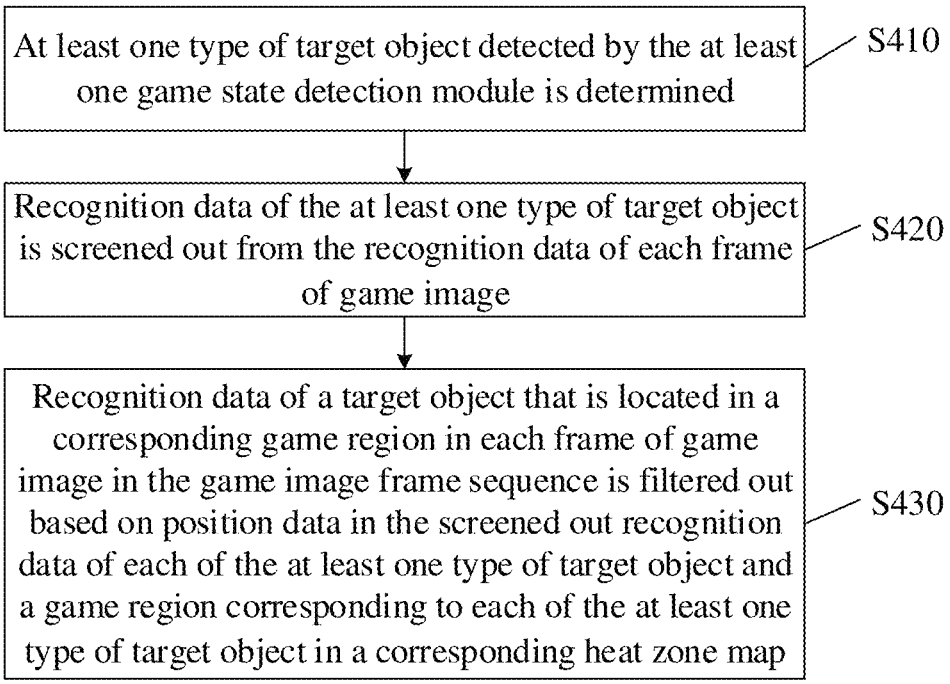
FIG. 4 illustrates a flowchart of a method for data processing according to an embodiment of the disclosure.

FIG. 4 illustrates a flowchart of a method for data processing according to an embodiment of the disclosure. As illustrated in FIG. 4, the operation in S230 or S350 that "recognition data of a game object that is located in a corresponding game region in each frame of game image is filtered out based on the type data, the position data, and the at least one heat zone map" may be implemented through the following process.

In S410, at least one type of detected by the at least one game state detection module is determined.

In some implementations, for a game state detection module that detects whether game currency in a betting region is changed, the at least one type of target object at least includes the game currency and a hand. In some other implementations, for a game state detection module that detects a game result, the at least one type of target object at least includes markers and pokers. In some other implementations, for a game state detection module that detects whether a process of exchanging currency with cash is normative, the at least one type of target object at least includes the cash, the game currency, and the hand. Types of target objects that are specifically included may be determined according to a practical condition. No limitation is set in the embodiment of the disclosure.

In S420, recognition data of the at least one type of target object is screened out from the recognition data of each frame of game image.

Here, the recognition data of each type of target object includes an identifier and position data of each type of target object. The recognition data of this type of target object is screened out from the recognition data of each frame of game image, and the position data in the recognition data is further determined.

During implementation, the at least one type of target object detected by each game state detection module is determined. Position data of each type of target object in the recognition data of each frame of game image is determined as a candidate information set. That is, at least one candidate information set is classified from the recognition data of each frame of game image. For example, all information of game currency in the recognition data of a present frame is extracted as a candidate information set S, and all information of hands in the recognition data of the present frame is extracted as a candidate information set M. As such, other recognized useless tabletop information is filtered away, and interferences to logic processing of the game state detection module are eliminated.

In some implementations, the type data includes a type identifier, and different types of target object correspond to different type identifiers. In S410, a type identifier set of the at least one type of target object detected by the at least one game state detection module may also be determined. Further, in S420, recognition data of each of the at least one type of target object is screened out based on the type identifier set.

Determining the type identifier set refers to determining identifiers of all target objects used by each game state detection module, to make it convenient to preliminarily filter away useless information. For example, the game table corresponds to three game state detection modules: a game state detection module A needs to detect pokers, a game state detection module B needs to detect game currency, and a game state detection module C needs to detect hands and game currency. In such case, type identifiers of the pokers, the hands and the game currency are determined at first.

It is to be noted that different types of target objects have corresponding object identifiers (agreed by the game state detection module and the parsing layer) for representing the objects types. For example, 1 represents faces, 2 represents cash, and 3 represents pokers.

In S430, recognition data of a target object that is located in a corresponding game region in each frame of game image in the game image frame sequence is filtered out based on position data in the screened out recognition data of each of the at least one type of target object and a game region corresponding to each of the at least one type of target object in a corresponding heat zone map.

Here, the recognition data of the target object is the recognition data of at least one type of target object.

In some implementations, the recognition data of the target object includes the position data, suit, and points of the poker, and position data, amount, nominal value, and associated operator identity of the game currency. In some other implementations, the recognition data of the target object includes position data, amount, nominal value, and associated operator identity of cash; and position data and associated operator identity of the hand. In some other implementations, the recognition data of the target object includes position data and indication content of the marker. Position data of an object (a poker, and a pile of game currency) includes a left-top vertex, right-bottom vertex, center coordinate, etc., of a detection box of the object.

During implementation, a position of each target object in each type of target object is compared in a traversing manner to see whether it can be mapped to the heat zone map of the corresponding game state detection module, to screen out the recognition data of the target object belonging to each heat zone map from the recognition data of each frame of game image.

Exemplarily, two game state detection modules B and C need to detect target objects of a game currency type. Therefore, the position data of all the game currency in the candidate information set S is sequentially compared with a position range corresponding to the heat zone map of game state detection module B to obtain a game currency subset S1 in the heat zone map of game state detection module B. Then, the position data of all the game currency in the candidate information set S is sequentially compared with a position range of the heat zone map of game state detection module C to obtain a game currency subset S2 in the heat zone map of game state detection module C.

Exemplarily, game state detection module C needs to detect target objects of a hand type. Then, the position data of all the hands in the candidate information set M is sequentially compared with the position range of the heat zone map of game state detection module C to obtain a hand subset M1 in the heat zone map of game state detection module C.

In the embodiments of the disclosure, at least one type of target data used by each game state detection module is classified at first to preliminarily filter away the useless tabletop information. Then the recognition data of the target object belonging to the corresponding heat zone map is screened out based on the position data of each type of target object. It is further realized that other recognition data at interference positions is filtered away for the heat zone map corresponding to each type of target object, so that each game state detection module may use the recognition data of the target object in the corresponding heat zone map directly, and the logic processing efficiency is improved.

Figure 5:
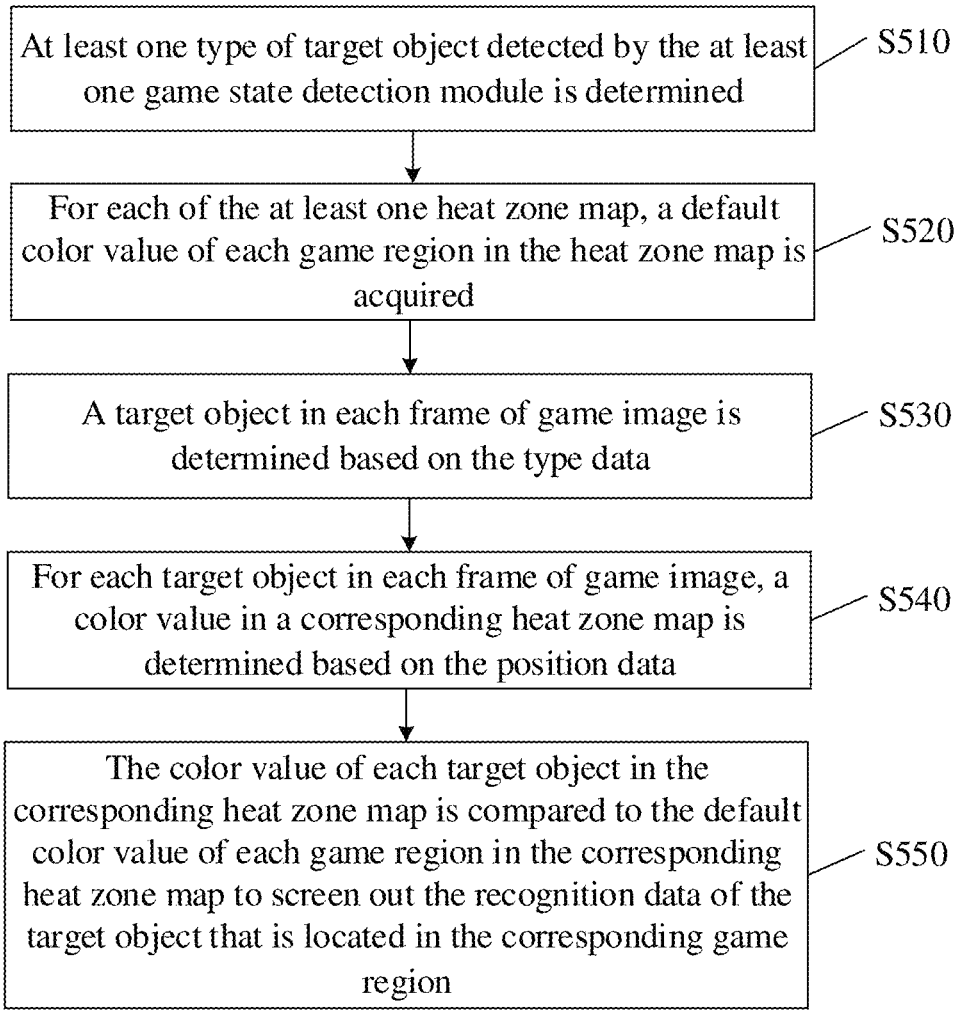
FIG. 5 illustrates a flowchart of a method for data processing according to an embodiment of the disclosure.

In some embodiments, the position data of each type of target object includes center coordinates, a left-top vertex, and a right-bottom vertex of each target object. The method for data processing provided in the disclosure will be described below with the condition that the position data is the center coordinates as an example. FIG. 5 illustrates a flowchart of a method for data processing according to an embodiment of the disclosure. As illustrated in FIG. 5, the operation in S230 or S350 that "recognition data of a game object that is located in a corresponding game region in each frame of game image is filtered out based on the type data, the position data, and the at least one heat zone map" may be implemented through the following process.

In S510, at least one type of target object detected by the at least one game state detection module is determined.

In S520, for each of the at least one heat zone map, a default color value of each game region in the heat zone map is acquired.

Here, each game region in the heat zone map has a respective different default color value. The default color value is a specific red, blue, green (RGB) value predefined for a corresponding hot zone in the configuration file. For example, a default color value of the player region may be set to fffdc7.

In S530, a target object in each frame of game image is determined based on the type data.

In S540, for each target object in each frame of game image, a color value in a corresponding heat zone map is determined based on the position data.

Exemplarily, position information of all the pokers in the present frame has been obtained by classification in S420, and each poker has center coordinates. A color value corresponding to the center coordinates of each poker in the corresponding heat zone map is sequentially determined.

In S550, the color value of each target object in the corresponding heat zone map is compared to the default color value of each game region in the corresponding heat zone map to screen out the recognition data of the target object that is located in the corresponding game region.

Exemplarily, a color value corresponding to center coordinates of a poker is fffdc7, while it is set in the configuration file that the default color value of the player hot zone is fffdc7. The color value corresponding to the center coordinates of the poker is consistent with the default color value of the player hot zone in the corresponding heat zone map. That is, the poker may be mapped to the player hot zone in the corresponding heat zone map, and it is thus determined that the poker is in the heat zone map.

Here, recognition results of all target objects that can be mapped to the corresponding heat zone maps are determined as recognition data of the target objects in the corresponding heat zone maps.

In some embodiments, the at least one type of target object includes at least one of: a poker, game currency, cash, a hand, or a marker. The recognition data of the target object includes at least one of: position data, suit, and points of the poker; position data, amount, nominal value, and associated operator identity of the game currency; position data, amount, nominal value, and associated operator identity of the cash; position data and associated operator identity of the hand; and position data and indication content of the marker.

In the embodiments of the disclosure, the color value in the corresponding heat zone map to which the center coordinates of the target object are mapped is sequentially compared with the default color value of all hot zones in the heat zone map to determine that the target object is in the corresponding heat zone map, thereby selecting the recognition data of the target object in the corresponding heat zone map. It is realized that different game state detection modules process the data in the corresponding heat zone according to their own service detection functions. In addition, a hot zone mapping attribute of the target object in the first heat zone map is determined to facilitate subsequent processing of the game state detection module based on the hot zone mapping attribute.

In some embodiments, each heat zone map corresponds to a game state detection module. A game state detection module may perform detection for the whole surface of the game table, and the corresponding heat zone map covers the whole surface of the game table. Alternatively, a game state detection module may perform detection for only part of the surface of the game table, for example, a module configured to detect a game currency placement state only performs detection in a game currency placement region; in such a case, the corresponding heat zone map may cover part of the surface of the game table.

Figure 6:
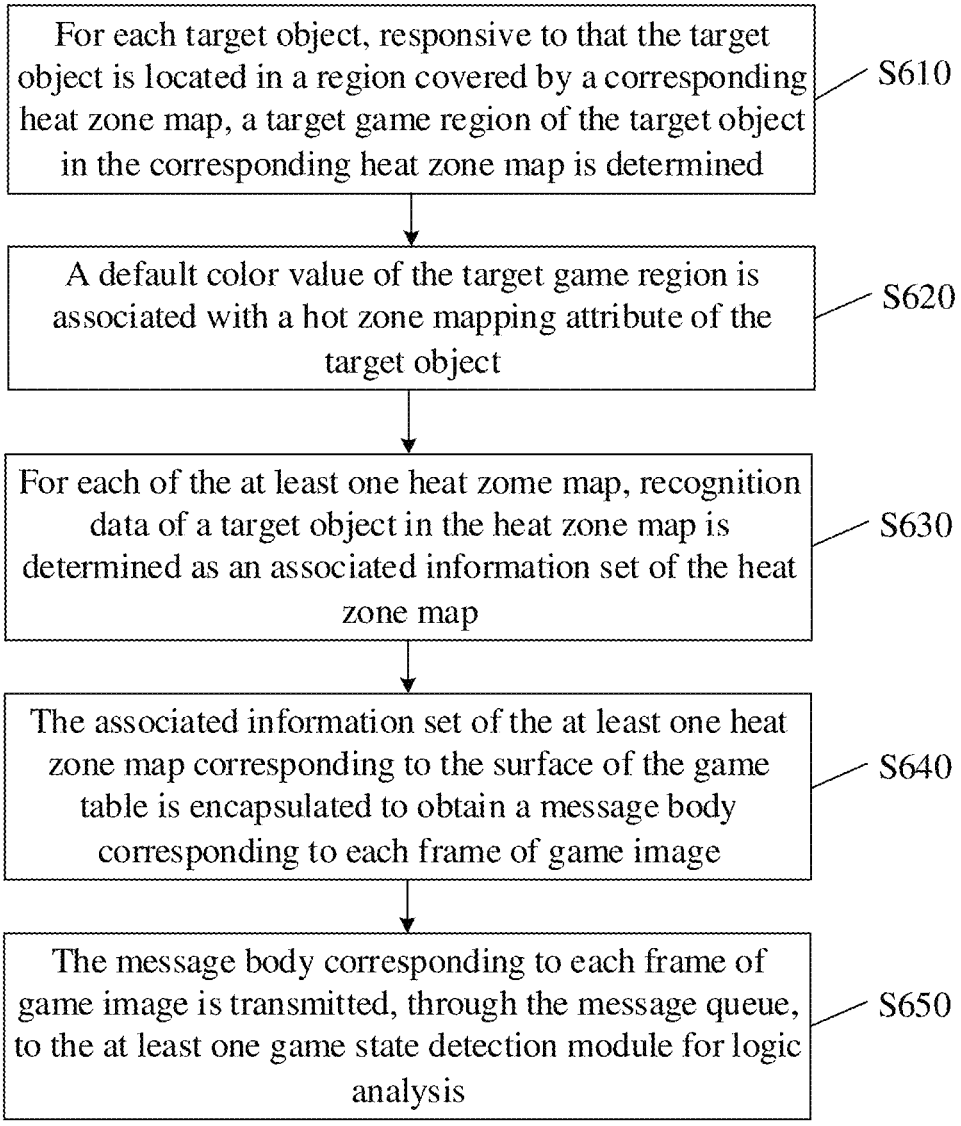
FIG. 6 illustrates a flowchart of a method for data processing according to an embodiment of the disclosure.

FIG. 6 illustrates a schematic flowchart of a method for data processing according to an embodiment of the disclosure. As illustrated in FIG. 6, the method further includes the following operations.

In S610, for each target object, responsive to that the target object is located in a region covered by a corresponding heat zone map, a target game region of the target object in the corresponding heat zone map is determined.

Here, a corresponding game region in a first heat zone map in which a default color value is consistent with the color value corresponding to the center coordinates of the target object is determined as the target game region.

In S620, a default color value of the target game region is associated with a hot zone mapping attribute of the target object.

Here, the hot zone mapping attribute is configured for the game state detection module corresponding to the heat zone map to perform logic analysis.

It is to be noted that the game state detection module reads a message from a message queue according to a subscribed subject, and extracts a required object attribute for corresponding service logic judgment. For example, the dealing sequence check module reads a hot zone mapping result of the poker and the suit and points of the poker, to check a dealing sequence of the dealer.

In S630, for each of the at least one heat zone map, recognition data of a target object in the heat zone map is determined as an associated information set of the heat zone map.

Here, through the previous steps, the recognition data of the target object belonging to each heat zone map is screened out from the recognition data of each frame of game image based on the position data of each type of target object and each heat zone map. To eliminate the need for different game state detection modules to repeatedly perform data cleaning and conversion operations, the filtered out recognition data of the target object in each heat zone map is stored as an associated information set of the corresponding heat zone map.

Exemplarily, the associated information set of the corresponding heat zone map may be hand information of the betting region, game currency information of the betting region, and poker information of the dealing region.

In S640, the associated information set of the at least one heat zone map corresponding to the surface of the game table is encapsulated to obtain a message body corresponding to each frame of game image.

Here, the message body is a data unit transmitted between two modules. The message body may be quite simple, for example, including only a text character string, or may be more complex, probably including an embedded object. In the embodiments of the disclosure, the filtered out associated information set of each heat zone map is determined as an attribute in the message body corresponding to each frame of game image.

In S650, the message body corresponding to each frame of game image is transmitted, through the message queue, to the at least one game state detection module for logic analysis.

Here, the message queue is implemented through message middleware. The message middleware is a support software system that provides synchronous or asynchronous reliable message transmission for an application system in a network system based on a queue and messaging technology.

Each game state detection module reads a message body from the message queue based on the subscribed subject, and extracts the associated information set of the corresponding heat zone map for corresponding service logic judgment.

It is to be noted that the service layer consumes and stores, in a sliding count window, the message body corresponding to each frame of image in the message queue. When the amount of information in the window reaches a sliding amount, a right edge of the window moves rightwards. That is, when there are message bodies of a first frame, a second frame, a third frame, a fourth frame, and a fifth frame in the window, responsive to that a message body of a sixth frame enters, the message body of the first message is pushed out, and each game state detection module performs parsing, and obtains an associated information set of the corresponding heat zone map to implement a related service logic. At this time, data in the window is the message bodies of the second to sixth frames.

The message queue mainly aims to provide a route and ensure message transmission. If a certain game state detection module is unavailable when a message is sent, the message queue may keep the message until the message may be transmitted successfully to the corresponding game state detection module. A main characteristic of the message queue is asynchronous processing, and mainly aims to quicken responses to requests and implement decoupling. Therefore, a main application scene is to put, in the message queue, a relatively time-consuming operation that does not require a result to be returned immediately. In addition, due to use of the message queue, as long as a message format is kept unchanged, a sender and receiver of a message body do not need to contact with each other, and may not be affected by each other, namely they are decoupled. Therefore, in the embodiments of the disclosure, cleaned data is encapsulated into a message body and pushed to the message queue, thus there is no need for different game state detection modules to repeatedly perform data cleaning and conversion operations.

In some possible embodiments, the edge AI node further includes a cache layer. Before a round of game starts, data stored in the cache layer is cleared. Responsive to that the game table enters a specific stage, an encapsulated message body corresponding to each frame of game image in the specific stage is stored in the cache layer. The specific stage includes at least one of: an idle stage, a betting stage, a gaming stage, a payout stage, and a halt stage. In this manner, an encapsulated message body corresponding to each frame of game image in each stage is stored in the cache layer, so that each game state detection module may subsequently directly acquire recognition content of the target object in the frame of image in the corresponding stage, and the flexibility in service logic processing is improved. In addition, there is no need for different game state detection modules to repeatedly perform data cleaning and conversion operations in different stages.

In the embodiments of the disclosure, the recognition data of each frame of game image is classified and filtered to form the associated information set of the heat zone map corresponding to each game state detection module, so that useless information in the original recognition data is filtered away, and the associated information sets that may be used by the game state detection modules directly are generated. In addition, all associated information sets in each frame of game image are encapsulated into message bodies for transmission to the game state detection modules, so that there is no need for different game state detection modules to repeatedly perform data cleaning and conversion operations.

The method for data processing will be described below in combination with a particular embodiment. However, it is to be noted that the particular embodiment is only for describing the application better and does not form improper limitation to the application.

The method for data processing provided in the embodiments of the disclosure may be applied to a casino scene. In the casino scene, the player mentioned anywhere in the embodiments of the disclosure may include a player or a banker. The game controller mentioned anywhere in the embodiments of the disclosure may refer to a dealer. The game table mentioned anywhere in the embodiments of the disclosure may refer to a gambling table. The game currency mentioned anywhere in the embodiments of the disclosure may include chips. The region mentioned anywhere in the embodiments of the disclosure may refer to a betting region on the game table. The management system mentioned anywhere in the embodiments of the disclosure may refer to a casino management (CMS).

In the embodiments of the disclosure, descriptions are made taking Baccarat (a card game) as an example. The dealer draws four to six cards from three to eight packs of shuffled cards, and a win-lose result may be obtained according to a rule. The win-lose result is divided into: the player wins, the bank wins, tie, etc. Gained or lost money of the player and the casino is calculated according to the win-lose result of each round of game, odds in different scenes, and whether to take brokerage. There are certain rules for dealing of the dealer and card peeking of the player. If the rules are broken, the monitoring system needs to output warning information.

In a game, at least one camera is used to detect what happens on the tabletop. A parsing layer performs detection and recognition on a shot image, and converts the shot image into computer information for transmission to each game state detection module of a service layer to perform further logic analysis.

There is a data cleaning service in the service layer. The parsing layer pushes out the detected and recognized data, the data including makers, pokers, chips, cash, etc. According to heat zone maps divided for different table types, the above data is mapped to different hot zones for filtering, and different game state detection modules process the data in corresponding hot zones according to their own service detection functions.

Data cleaning refers to performing further preprocessing over the data pushed out by the parsing layer to filter away useless data and convert the data into data that may be used by a service side directly. There is no need for different game state detection modules to repeatedly perform data cleaning and conversion operations. When pushing the data, the parsing layer may push out all information recognized on the tabletop. However, during processing of the service layer, some tabletop information is useless, and interferes to service logic processing, so it is necessary to filter away the useless information. It is difficult to define useless information.

Figure 7A:
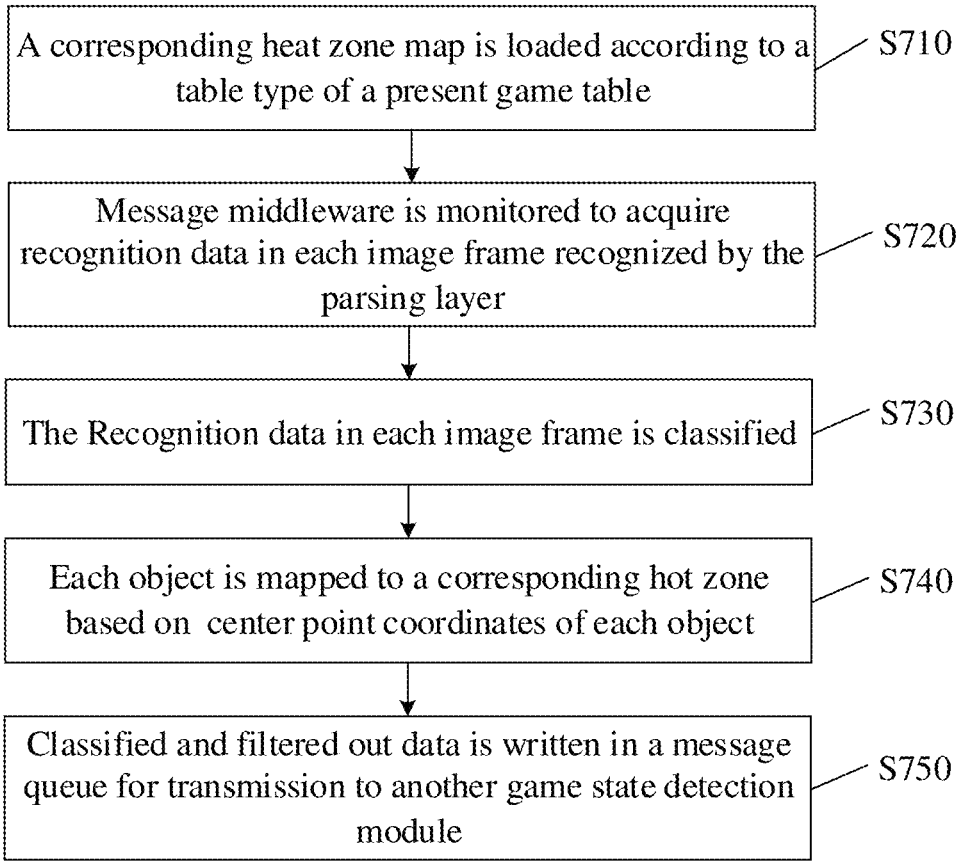
FIG. 7A illustrates a logic flowchart of a method for data processing according to an embodiment of the disclosure.

FIG. 7A illustrates a logic flowchart of a method for data processing according to an embodiment of the disclosure. As illustrated in FIG. 7A, the method includes the following operations.

In S710, a corresponding heat zone map is loaded according to a table type of a present game table.

Here, the management system may issue the table type of the present game table through a configuration file. Heat zone maps corresponding to different table types are different, and need to be loaded according to configurations. For example, Tiger Fighter and Baccarat correspond to respective different table types.

Figure 7B:
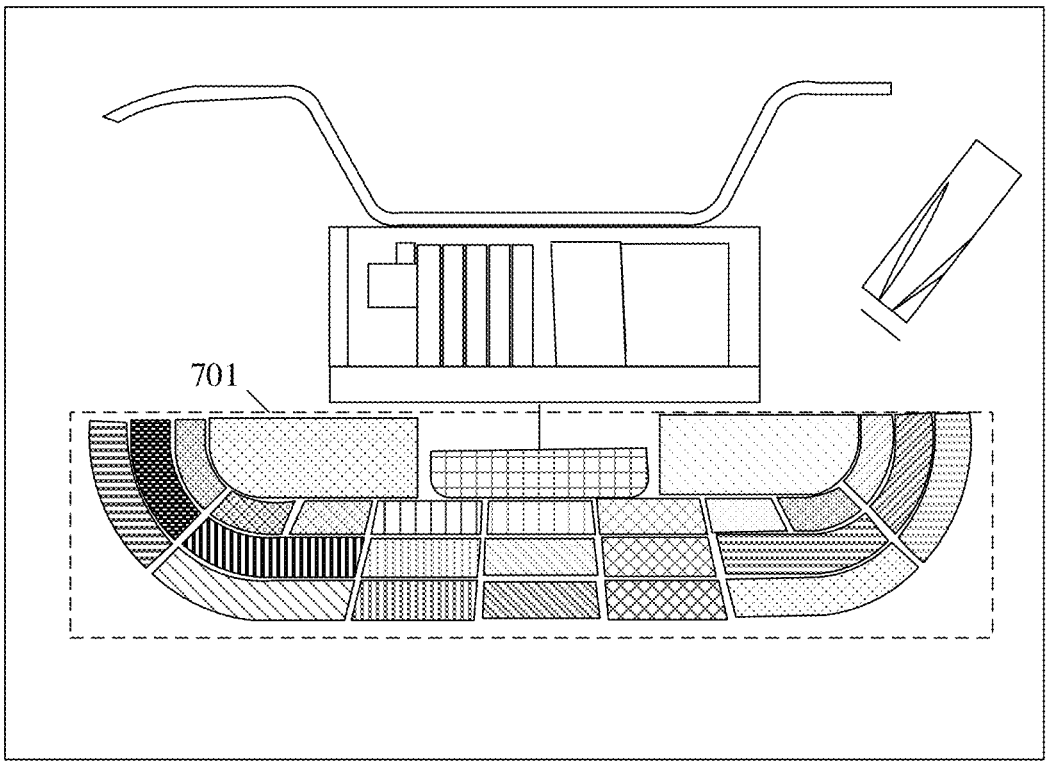
FIG. 7B illustrates a heat zone map corresponding to a game table according to an embodiment of the disclosure.
Figure 7C:
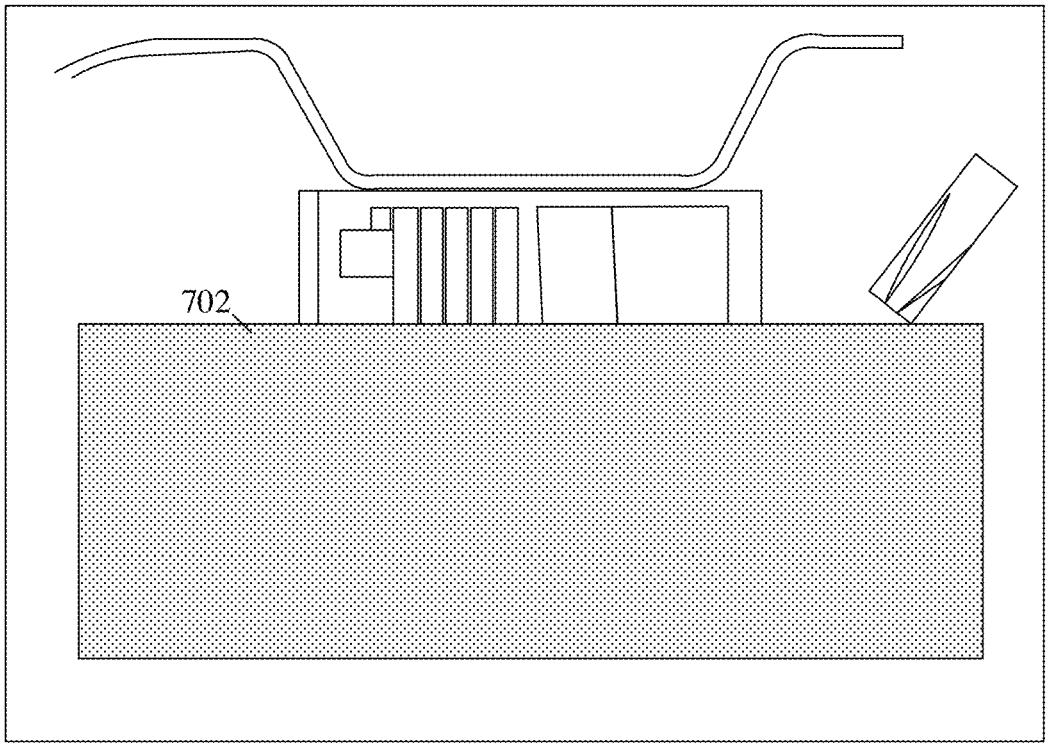
FIG. 7C illustrates another heat zone map corresponding to a game table according to an embodiment of the disclosure.
Figure 7D:
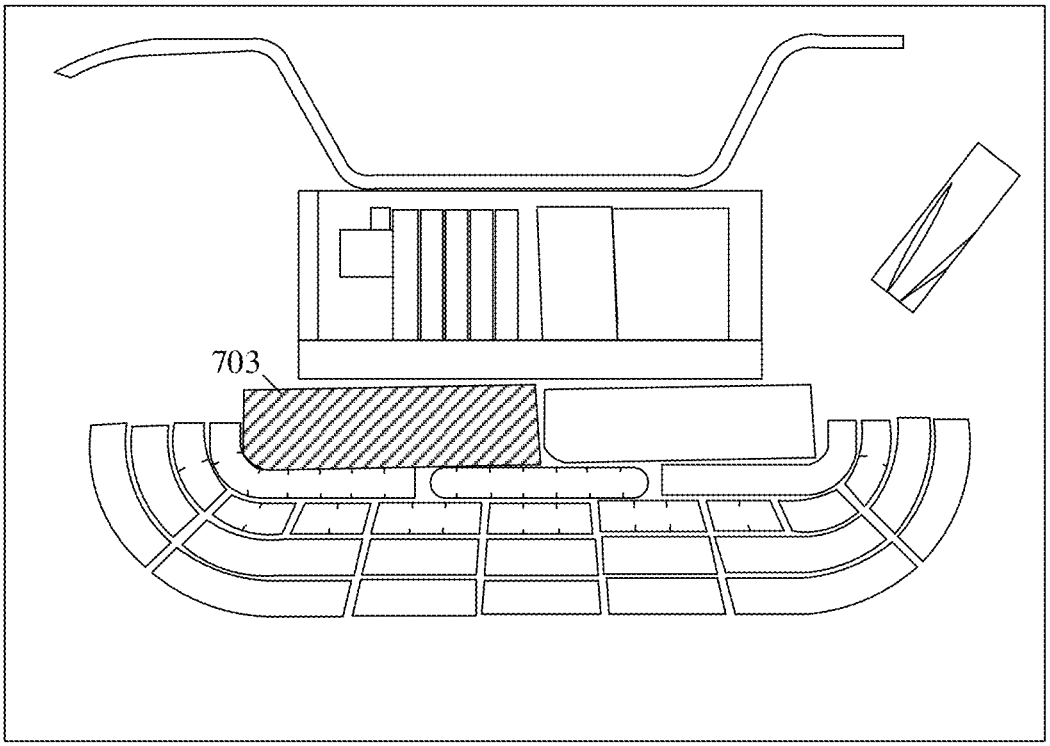
FIG. 7D illustrates yet another heat zone map corresponding to a game table according to an embodiment of the disclosure.

It is to be noted that heat zone maps divided for different game state detection modules based on a target object and region detected by each game state detection module are stored in the configuration file. As illustrated in FIG. 7B, a chip detection module is configured to detect whether chips in a betting region are changed by an irregular behavior, and needs to use chip information recognized by the parsing layer, and thus all betting regions 701 are determined as a heat zone map of the chip detection module. As illustrated in FIG. 7C, a dealing sequence check module is configured to monitor a progress of a game and judge a result of each round of game, and needs to use poker information recognized by the parsing layer, namely positions 702 where pokers need to be placed from the start to end of the game are determined as a heat zone map of the dealing sequence check module. As illustrated in FIG. 7D, a cash detection module is configured to detect whether an exchange process of between cash and chips is regular, and since it is specified in the game that a player and a game manager exchange cash only in a player region, the player region 703 is determined as a heat zone map of the cash detection module.

In S720, message middleware is monitored to acquire recognition data in each image frame recognized by the parsing layer.

Here, a message queue is constructed through the message middleware. The parsing layer performs detection and recognition on each image frame that is shot, to obtain the recognition data of the corresponding image frame, and sends the recognition data to the message queue. The service layer consumes the recognition data in each image frame from the message queue.

It is to be noted that the parsing layer performs detection and recognition according to data acquired by three cameras, and may provide all detection and recognition data of each frame, for example, including position coordinates, suits, and points of pokers; positions and nominal values of chips; and person identities associated with the chips.

In S730, the recognition data in each image frame is classified.

Here, recognition data of the same type of objects is classified and filtered out by processing according to the consumed recognition data in each image frame, and is stored in a corresponding message body. The recognition data of all the chips is stored in a message body corresponding to chip, and all the recognition data of all the pokers is stored in a message body corresponding to poker.

It is to be noted that the recognition data in each image frame includes multiple types of objects. Message bodies corresponding to different types of objects have corresponding identifiers for representing the types of the objects (set according to a service requirement). For example, 1 represents faces, 2 represents cash, and 3 represents pokers.

In S740, each object is mapped to a corresponding hot zone based on center point coordinates of each object.

Here, the recognition data pushed out by the parsing layer includes the center point coordinate of each object. First, the recognition data of this type of object in a present frame of image is obtained through the previous step, to determine the center point coordinates of each object. Then, a color value corresponding to the position is acquired from the corresponding heat zone map based on the center point coordinates. Finally, the present position is judged according to the color value, namely the object is mapped to the corresponding heat zone map.

Taking mapping of pokers as an example, each object is mapped to the corresponding heat zone map based on a center point coordinate of the object.

Here, a dealing region of the recognized pokers pushed out by the parsing layer may include a player hot zone and a banker hot zone. The center point coordinates of all the pokers in the present frame are acquired from the recognition data obtained by classification in the previous step, and a corresponding color value is acquired from the heat zone map based on each center point coordinate. Then, the acquired color value is compared with practical color values of hot zones (for example, a color value of the player hot zone is fffdc7) to determine the hot zone that the corresponding poker is mapped to.

It is to be noted that the practical color value of the hot zone refers to a predefined color value of each hot zone in the heat zone map. Different hot zones correspond to respective different color values. For example, the practical color value of the player hot zone is fffdc7, and manifests as yellow; and a practical color value of the banker hot zone is 00fff, and manifests as green. The color value of the center point coordinates of the poker mapped to the heat zone map may be compared with the predefined practical color value of each hot zone to determine a hot zone mapping result of the poker.

Figure 7E:
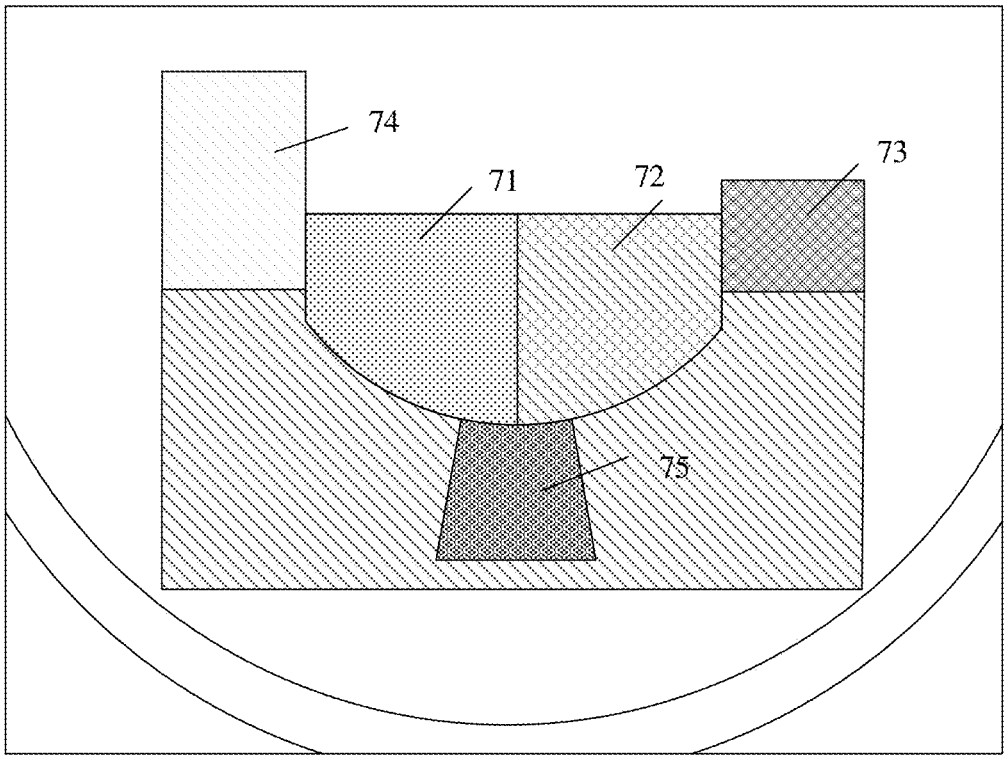
FIG. 7E illustrates a schematic diagram of hot zones in a heat zone map according to an embodiment of the disclosure.

As such, for each type of object, other interference data is filtered away from the corresponding heat zone map. For example, the dealing sequence check module needs to detect the pokers in the dealing region, and thus the poker information may be filtered in the heat zone map of the dealing region to obtain the pokers only in the heat zone map of the dealing region. The heat zone map for detection of the pokers is as shown in FIG. 7E. A region 71 is a player hot zone, a region 72 is a banker hot zone, a region 73 is a card pulling region, a region 74 is a region of useless cars, and a region 75 is a region of discarded cards. A corresponding game state detection module that detects the pokers judges a stage that the game is in based on a real-time position of the poker.

In S750, classified and filtered out data is written in a message queue for transmission to another game state detection module.

Here, the hot zone mapping result obtained in the previous step may be pushed to the message queue as an attribute value of a message body of the object (a poker, a pile of chips, a hand, etc.). As such, the cleaned data is encapsulated into a message body (namely the message body includes multiple attributes, such as attribute information of the poker in the dealing region, the chip in the betting region, and the hand in the betting region) for synchronization to the other game state detection modules through a message object.

In the embodiments of the disclosure, the heat zone maps are divided for different game state detection modules on one hand. On the other hand, information of the same type of objects is classified according to the recognition data of each frame of image pushed out by the parsing layer, and then, for each type of object, the other interference data is filtered away from the heat zone map corresponding to each game state detection module. In this manner, the recognition data of each frame of image is mapped to different hot zones for filtering, and different game state detection modules process the data in corresponding hot zones according to their own service detection functions. According to the embodiment of the disclosure, data cleaning is performed on the recognition data pushed out by the parsing layer, and the cleaned data is encapsulated into a message body for pushing to the message queue, so that the logic judgment flexibility of the game state detection module is improved. In addition, the data is converted into structural information bodies that may be used by different modules of the service layer directly, so that there is no need for different game state detection modules to repeatedly perform data cleaning and conversion operations.

Based on the abovementioned embodiments, the embodiments of the disclosure also provide an apparatus for data processing. Modules of the apparatus and submodules and units of the modules may be implemented through a processor in an electronic device, and of course, may also be implemented through a specific logic circuit. During implementation, the processor may be a Central Processing Unit (CPU), a Micro Processing Unit (MPU), a Digital Signal Processor (DSP), a Field Programmable Gate Array (FPGA), etc.

Figure 8:
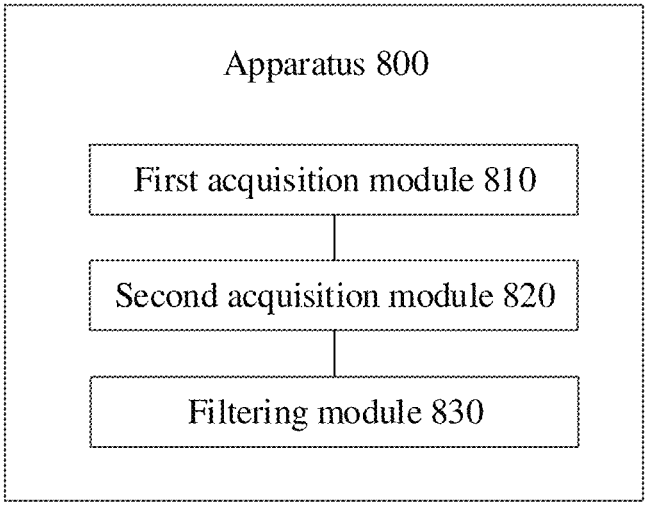
FIG. 8 illustrates a composition structural diagram of an apparatus for data processing according to an embodiment of the disclosure.

FIG. 8 illustrates a schematic structural diagram of composition of an apparatus for data processing according to an embodiment of the disclosure. As illustrated in FIG. 8, the apparatus 800 includes a first acquisition module 810, a second acquisition module 820, and a filtering module 830.

The first acquisition module 810 is configured to acquire recognition data obtained by performing game object recognition on each frame of game image in a game image frame sequence. The recognition data includes type data of a game object and position data of the game object on a game table.

The second acquisition module 820 is configured to acquire at least one heat zone map corresponding to a surface of the game table. Each heat zone map represents a game region on the surface of the game table corresponding to each of respective at least one game object type.

The filtering module 830 is configured to filter out, based on the type data, the position data, and the at least one heat zone map, recognition data of a game object that is located in a corresponding game region in each frame of game image in the game image frame sequence.

In some possible embodiments, the second acquisition module 820 is further configured to a corresponding heat zone map for each of at least one game state detection module.

In some possible embodiments, the second acquisition module 820 includes a first determination submodule and a loading submodule. The first determination submodule is configured to determine the at least one game state detection module based on a type of the game table, and the loading submodule is configured to load a corresponding heat zone map for each of the at least one game state detection module by reading a configuration file corresponding to the game table.

In some possible embodiments, the filtering module includes a second determination submodule, a classification submodule, and a filtering submodule. The second determination submodule is configured to determine at least one type of target object detected by the at least one game state detection module. The classification submodule is configured to screen out, from the recognition data of each frame of game image in the game image frame sequence, recognition data of the at least one target object type. The filtering submodule is configured to filter out recognition data of a target object that is located in a corresponding game region in each frame of game image in the game image frame sequence based on position data in the screened out recognition data of each of the at least one type of target object and a game region corresponding to each of the at least one type of target object in a corresponding heat zone map.

In some possible embodiments, the type data includes a type identifier. The determination submodule is further configured to determine a type identifier set of the at least one type of target object detected by the at least one game state detection module. The classification submodule is further configured to screen out recognition data of each of the at least one type of target object based on the type identifier set.

In some possible embodiments, the filtering module includes a second determination submodule, an acquisition submodule, a third determination submodule, a fourth determination submodule, and a screening submodule. The second determination submodule is configured to determine at least one type of target object detected by the at least one game state detection module. The acquisition submodule is configured to: for each of the at least one heat zone map, acquire a default color value of each game region in the heat zone map. Each game region in the heat zone map has a respective different default color value. The third determination submodule is configured to determine a target object in each frame of game image based on the type data. The fourth determination submodule is configured to determine, for each target object in each frame of game image, a color value in a corresponding heat zone map based on the position data. The screening submodule is configured to compare the color value of each target object in the corresponding heat zone map to the default color value of each game region in the corresponding heat zone map to screen out the recognition data of the target object that is located in the corresponding game region.

In some possible embodiments, the position data includes center coordinates, and each of the at least one heat zone map covers part of the surface of the game table. The filtering module further includes a third determination submodule and an association submodule. The third determination submodule is configured to: for each target object, responsive to that the target object is located in a region covered by a corresponding heat zone map, determine a target game region of the target object in the corresponding heat zone map. The association submodule is configured to associate a default color value of the target game region with a hot zone mapping attribute of the target object. The hot zone mapping attribute is configured for a game state detection module corresponding to the corresponding heat zone map to perform logic analysis.

In some possible embodiments, the apparatus 800 further includes a determination module, an encapsulation module, and a synchronization module. The determination module is configured to: for each of the at least one heat zone map, determine recognition data of a target object in the heat zone map as an associated information set of the heat zone map. The encapsulation module is configured to encapsulate the associated information set of the at least one heat zone map corresponding to the surface of the game table to obtain a message body corresponding to each frame of game image. The synchronization module is configured to transmit, through a message queue, the message body corresponding to each frame of game image to the at least one game state detection module for logic analysis. Each of the at least one game state detection module reads the message body from the message queue based on a subscribed subject, and extracts the associated information set of a corresponding heat zone map for corresponding service logic judgment.

In some possible embodiments, the first acquisition module 810 is further configured to acquire, through a message queue, the recognition data obtained by performing game object recognition on each frame of game image in the image frame sequence. The recognition data is obtained by performing detection and recognition on each frame of game image and is input to the message queue.

In some possible embodiments, the apparatus 800 further includes a storage module, configured to: clear data stored in a cache layer before start of a round of game; and responsive to that the game table enters a specific stage, store, to the cache layer, an encapsulated message body corresponding to each frame of game image in the specific stage.

It is to be pointed out that descriptions about the above apparatus embodiment are similar to descriptions about the method embodiment, and beneficial effects similar to those of the method embodiment are achieved. Technical details undisclosed in the apparatus embodiments of the disclosure may be understood with reference to the descriptions about the method embodiments of the disclosure.

It is to be noted that, in the embodiments of the disclosure, when implemented in form of software function module and sold or used as an independent product, the method for data processing may also be stored in a computer-readable storage medium. Based on such an understanding, the technical solutions of the embodiments of the disclosure substantially or parts making contributions to the related art may be embodied in form of software product. The computer software product is stored in a storage medium, including multiple instructions configured to enable an electronic device (which may be a smart phone with a camera, a tablet computer, etc.) to execute all or part of the method in various embodiments of the disclosure. The storage medium includes various media capable of storing program codes such as a USB flash disk, a mobile hard disk, a Read Only Memory (ROM), a magnetic disk, or an optical disk. Therefore, the embodiments of the disclosure are not limited to any specific hardware and software combination.

Correspondingly, the embodiments of the disclosure provide a computer-readable storage medium, having stored thereon a computer program that, when being executed by a processor, implements the steps in any method for data processing as described in the abovementioned embodiments. Correspondingly, there is also provided a chip in the embodiments of the disclosure. The chip includes a programmable logic circuit and/or a program instruction. The chip, when running, implements the steps in any method for data processing as described in the abovementioned embodiments. Correspondingly, there is also provided a computer program product in the embodiments of the disclosure. The computer program product, when run by a processor of an electronic device, implements the steps in any method for data processing as described in the abovementioned embodiments.

Figure 9:
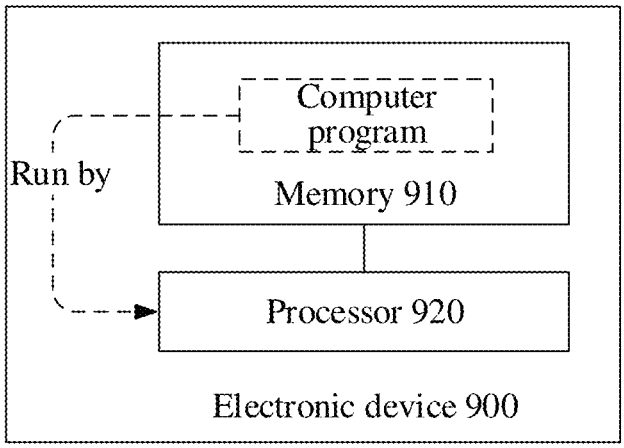
FIG. 9 illustrates a schematic diagram of a hardware entity of an electronic device according to an embodiment of the disclosure.

Based on the same technical concept, the embodiments of the disclosure provide an electronic device, which is configured to implement a method for data processing recorded in the method embodiments. FIG. 9 illustrates a schematic diagram of a hardware entity of an electronic device according to an embodiment of the disclosure. As illustrated in FIG. 9, the electronic device 900 includes a memory 910 and a processor 920. The memory 910 stores a computer program capable of running in the processor 920. The processor 920 executes the program to implement the steps in any method for data processing as described in the embodiments of the disclosure.

The memory 910 is configured to store instructions and an application executable for the processor 920, may also buffer data (for example, image data, video data, voice communication data, and video communication data) to be processed or having been processed by the processor 920 and each module in the electronic device 400, and may be implemented through a flash or a Random Access Memory (RAM).

The processor 920 executes the program to implement the steps of any abovementioned method for data processing. The processor 920 usually controls overall operations of the electronic device 900.

The processor may be at least one of an Application Specific Integrated Circuit (ASIC), a Digital Signal Processor (DSP), a Digital Signal Processing Device (DSPD), a Programmable Logic Device (PLD), a Field Programmable Gate Array (FPGA), a Central Processing Unit (CPU), a controller, a microcontroller, or a microprocessor. It can be understood that other electronic devices may also be configured to realize functions of the processor, and no specific limitation is set in the embodiments of the disclosure.

The computer storage medium/memory may be a memory such as a ROM, a Programmable Read-Only Memory (PROM), an Erasable Programmable Read-Only Memory (EPROM), an Electrically Erasable Programmable Read-Only Memory (EEPROM), a Ferromagnetic Random Access Memory (FRAM), a flash memory, a magnetic surface memory, an optical disk, or a Compact Disc Read-Only Memory (CD-ROM), or may be any electronic device including one or any combination of the abovementioned memories, such as a mobile phone, a computer, a tablet device, a personal digital assistant, and a server.

It is to be pointed out here that the above descriptions about the storage medium and device embodiments are similar to the descriptions about the method embodiment, and beneficial effects similar to those of the method embodiment are achieved. Technical details undisclosed in the storage medium and device embodiment of the disclosure are understood with reference to the descriptions about the method embodiment of the disclosure.

It is to be understood that "one embodiment" and "an embodiment" mentioned in the whole specification mean that specific features, structures or characteristics related to the embodiment is included in at least one embodiment of the disclosure. Therefore, "in one embodiment" or "in an embodiment" mentioned throughout the specification does not always refer to the same embodiment. In addition, these specific features, structures or characteristics may be combined in one or more embodiments freely as appropriate. It is to be understood that, in each embodiment of the disclosure, a magnitude of a sequence number of each process does not mean an execution sequence and the execution sequence of each process should be determined by its function and an internal logic and should not form any limitation to an implementation process of the embodiments of the disclosure. The sequence numbers of the embodiments of the disclosure are adopted not to represent superiority-inferiority of the embodiments but only for description.

It is to be noted that terms "include" and "contain" or any other variant thereof is intended to cover nonexclusive inclusions herein, so that a process, method, object or device including a series of elements not only includes those elements but also includes other elements which are not clearly listed or further includes elements intrinsic to the process, the method, the object or the device. Under the condition of no more limitations, an element defined by the statement "including a/an" does not exclude existence of the same other elements in a process, method, object or device including the element.

In some embodiments provided in the disclosure, it is to be understood that the disclosed device and method may be implemented in another manner. The device embodiment described above is only illustrative, and for example, division of the units is only logic function division, and other division manners may be adopted during practical implementation. For example, multiple units or components may be combined or integrated into another system, or some characteristics may be neglected or not executed. In addition, coupling or direct coupling or communication connection between various displayed or discussed components may be indirect coupling or communication connection implemented through some interfaces, devices or units, and may be electrical and mechanical or in other forms.

The units described as separate parts may or may not be physically separated, and parts displayed as units may or may not be physical units, and namely may be located in the same place, or may also be distributed to multiple network units. Some or all of the units may be selected according to a practical requirement to achieve the purposes of the solutions of the embodiments of the disclosure.

In addition, function units in the embodiments of the disclosure may be integrated into a processing unit, or each unit may also serve as an independent unit and two or more than two units may also be integrated into a unit. The integrated unit may be implemented in a hardware form and may also be implemented in form of hardware and software function unit.

Alternatively, when implemented in form of software function module and sold or used as an independent product, the integrated unit of the disclosure may also be stored in a computer-readable storage medium. Based on such an understanding, the technical solutions of the embodiments of the disclosure substantially or parts making contributions to the related art may be embodied in form of a software product. The computer software product is stored in a storage medium, including multiples instructions configured to enable an automatic test line of a device to execute all or part of the method in each embodiment of the disclosure. The storage medium includes: various media capable of storing program codes such as a mobile hard disk, a ROM, a magnetic disk, or an optical disc.

The methods disclosed in some method embodiments provided in the disclosure may be freely combined without conflicts to obtain new method embodiments.

The characteristics disclosed in some method or device embodiments provided in the disclosure may be freely combined without conflicts to obtain new method embodiments or device embodiments.

The above are only implementations of the application and not intended to limit the scope of protection of the application. Any variations or replacements apparent to those skilled in the art within the technical scope disclosed by the application shall fall within the scope of protection of the application. Therefore, the scope of protection of the application shall be subject to the scope of protection of the claims.

The invention claimed is:

1. A method for data processing, performed by a processor of an end device, comprising:

acquiring recognition data obtained by performing game object recognition on each frame of game image in a game image frame sequence acquired by a camera, wherein the recognition data comprises type data of a game object and position data of the game object on a game table, wherein the position data comprises center coordinates;

acquiring at least one heat zone map corresponding to a surface of the game table, wherein each heat zone map represents a game region on the surface of the game table corresponding to a game object type detected by a respective game state detection module, wherein each game state detection module corresponds to a respective detection function for detecting an attribute of an object in the game region on the surface of the game table and making logic judgment;

for each of the at least one heat zone map, acquiring a default color value of each game region in the heat zone map, wherein each game region in the heat zone map has a respective different default color value;

determining target objects in each frame of game image based on the type data; and for each of the target objects, determining a color value in the heat zone map based on the center coordinates of the target object, comparing the color value of the target object to the default color value of each game region in the heat zone map to determine whether the target object is located in a region covered by the heat zone map, and in response to the target object being located in the region covered by the heat zone map, selecting the recognition data of the target object, determining a target game region of the target object in the heat zone map and associating a default color value of the target game region with a heat zone mapping attribute of the target object;

wherein the heat zone mapping attribute is configured for a game state detection module corresponding to the heat zone map to perform logic analysis, and the selected recognition data is used for the end device to recognize an irregular action.

2. The method of claim 1, wherein the acquiring the at least one heat zone map corresponding to the surface of the game table comprises:

acquiring a corresponding heat zone map for each of at least one game state detection module.

3. The method of claim 2, wherein the acquiring a corresponding heat zone map for each of the at least one game state detection module comprises:

determining the at least one game state detection module based on a type of the game table; and loading a corresponding heat zone map for each of the at least one game state detection module by reading a configuration file corresponding to the game table.

4. The method of claim 2, wherein the determining target objects in each frame of game image based on the type data comprises:

determining at least one type of target object detected by each game state detection module; and selecting, from the recognition data of each frame of game image in the game image frame sequence, recognition data of the at least one type of target object detected by each game state detection module.

5. The method of claim 4, wherein the type data comprises a type identifier, and the determining the at least one type of target object detected by each game state detection module comprises:

determining a type identifier set of the at least one type of target object detected by each game state detection module; and selecting, from the recognition data of each frame of game image in the game image frame sequence, the recognition data of the at least one type of target object detected by each game state detection module comprises:

selecting recognition data of each of the at least one type of target object based on the type identifier set.

6. The method of claim 4, further comprising:

for each of the at least one heat zone map, determining recognition data of a target object in the heat zone map as an associated information set of the heat zone map;

encapsulating the associated information set of the at least one heat zone map corresponding to the surface of the game table to obtain a message body corresponding to each frame of game image; and transmitting, through a message queue, the message body corresponding to each frame of game image to the at least one game state detection module for logic analysis, wherein each of the at least one game state detection module reads the message body from the message queue based on a subscribed subject, and extracts the associated information set of a corresponding heat zone map for corresponding service logic judgment.

7. The method of claim 6, further comprising:

clearing data stored in a cache layer before start of a round of game; and responsive to the game table entering a specific stage, storing, to the cache layer, an encapsulated message body corresponding to each frame of game image in the specific stage.

8. The method of claim 4, wherein the at least one type of target object comprises at least one of: a poker, game currency, cash, a hand, or a marker; and the recognition data of the target object comprises at least one of:

position data, suit, and points of the poker, position data, amount, nominal value, and associated operator identity of the game currency, position data, amount, nominal value, and associated operator identity of the cash, position data and associated operator identity of the hand, or position data and indication content of the marker.

9. The method of claim 1, wherein the acquiring the recognition data obtained by performing game object recognition on each frame of game image in the game image frame sequence acquired by the camera comprises:

acquiring, through a message queue, the recognition data obtained by performing game object recognition on each frame of game image in the game image frame sequence, wherein the recognition data is obtained by performing detection and recognition on each frame of game image and is input to the message queue.

10. The method of claim 1, wherein among the at least one heat zone map, a first heat zone map contains at least one zone different from a second heat zone map.

11. The method of claim 1, wherein a game state detection module determines a present stage of a game according to center coordinates of a type of game objects.

12. An end device, comprising:

a processor; and a memory configured to store instructions which, when being executed by the processor, cause the processor to carry out the following:

acquiring recognition data obtained by performing game object recognition on each frame of game image in a game image frame sequence acquired by a camera, wherein the recognition data comprises type data of a game object and position data of the game object on a game table, wherein the position data comprises center coordinates;

acquiring at least one heat zone map corresponding to a surface of the game table, wherein each heat zone map represents a game region on the surface of the game table corresponding to a game object type detected by a respective game state detection module, wherein each game state detection module corresponds to a respective detection function for detecting an attribute of an object in the game region on the surface of the game table and making logic judgment;

for each of the at least one heat zone map, acquiring a default color value of each game region in the heat zone map, wherein each game region in the heat zone map has a respective different default color value;

determining target objects in each frame of game image based on the type data; and for each of the target objects, determining a color value in the heat zone map based on the center coordinates of the target object, comparing the color value of the target object to the default color value of each game region in the heat zone map to determine whether the target object is located in a region covered by the heat zone map, and in response to the target object being located in the region covered by the heat zone map, selecting the recognition data of the target object, determining a target game region of the target object in the heat zone map and associating a default color value of the target game region with a heat zone mapping attribute of the target object;

wherein the heat zone mapping attribute is configured for a game state detection module corresponding to the heat zone map to perform logic analysis, and the selected recognition data is used for the end device to recognize an irregular action.

13. The end device of claim 12, wherein in acquiring the at least one heat zone map corresponding to the surface of the game table, the processor is caused to carry out the following: acquiring a corresponding heat zone map for each of at least one game state detection module.

14. The end device of claim 13, wherein in acquiring a corresponding heat zone map for each of the at least one game state detection module, the processor is caused to carry out the following determining the at least one game state detection module based on a type of the game table; and loading a corresponding heat zone map for each of the at least one game state detection module by reading a configuration file corresponding to the game table.

15. The end device of claim 12, wherein in determining target objects in each frame of game image based on the type data, the processor is caused to carry out the following:

determining at least one type of target object detected by each game state detection module; and selecting, from the recognition data of each frame of game image in the game image frame sequence, recognition data of the at least one type of target object detected by each game state detection module.

16. The end device of claim 15, wherein the type data comprises a type identifier;

in determining the at least one type of target object detected by each game state detection module, the processor is caused to carry out the following: determining a type identifier set of the at least one type of target object detected by each game state detection module; and in selecting, from the recognition data of each frame of game image in the game image frame sequence, the recognition data of the at least one type of target object detected by each game state detection module, the processor is caused to carry out the following: selecting recognition data of each of the at least one type of target object based on the type identifier set.

17. The end device of claim 12, wherein in acquiring the recognition data obtained by performing game object recognition on each frame of game image in the game image frame sequence acquired by the camera, the processor is caused to carry out the following:

acquiring, through a message queue, the recognition data obtained by performing game object recognition on each frame of game image in the game image frame sequence, wherein the recognition data is obtained by performing detection and recognition on each frame of game image and is input to the message queue.

18. A non-transitory computer-readable storage medium having stored thereon a computer program that, when being executed by a processor of an end device, implements steps in a method for data processing, the method comprising:

acquiring recognition data obtained by performing game object recognition on each frame of game image in a game image frame sequence acquired by a camera, wherein the recognition data comprises type data of a game object and position data of the game object on a game table, wherein the position data comprises center coordinates;

acquiring at least one heat zone map corresponding to a surface of the game table, wherein each heat zone map represents a game region on the surface of the game table corresponding to a game object type detected by a respective game state detection module, wherein each game state detection module corresponds to a respective detection function for detecting an attribute of an object in the game region on the surface of the game table and making logic judgment;

for each of the at least one heat zone map, acquiring a default color value of each game region in the heat zone map, wherein each game region in the heat zone map has a respective different default color value;

determining target objects in each frame of game image based on the type data;

for each of the target objects, determining a color value in the heat zone map based on the center coordinates of the target object, comparing the color value of the target object to the default color value of each game region in the heat zone map to determine whether the target object is located in a region covered by the heat zone map, and in response to the target object being located in the region covered by the heat zone map, selecting the recognition data of the target object, determining a target game region of the target object in the heat zone map and associating a default color value of the target game region with a heat zone mapping attribute of the target object;

wherein the heat zone mapping attribute is configured for a game state detection module corresponding to the heat zone map to perform logic analysis, and the selected recognition data is used for the end device to recognize an irregular action.

* * * * *